United States Patent [19]

Andoe

[11] Patent Number: 4,772,344

[45] Date of Patent: Sep. 20, 1988

[54] METHOD OF PROTECTING THE HULLS OF MARINE VESSELS FROM FOULING

[75] Inventor: Graham C. Andoe, Ft. Lauderdale, Fla.

[73] Assignee: Jimi R. Andoe, Dunwoodie, Ga.

[21] Appl. No.: 938,139

[22] Filed: Dec. 4, 1986

[51] Int. Cl.[4] ..... B29C 53/04; G01B 3/12; G01B 5/20

[52] U.S. Cl. ..... 156/64; 156/71; 156/212; 156/360; 156/378; 204/147; 422/8

[58] Field of Search ..... 156/71, 64, 353, 212, 156/196, 250, 256, 360, 378, 379; 422/6, 8; 114/356, 361; 204/148, 197, 147

[56] References Cited

U.S. PATENT DOCUMENTS

| | | | |
|---|---|---|---|
| Re. 30,771 | 10/1981 | Zondek | 156/71 |
| 1,967,841 | 7/1934 | Perry | 204/147 |
| 3,421,990 | 1/1969 | Penix | 204/148 |
| 3,726,779 | 4/1973 | Morgan | 204/197 |
| 3,761,334 | 9/1973 | Zondek | 156/71 |
| 3,775,219 | 11/1973 | Karlson et al. | 156/353 |
| 3,855,044 | 12/1974 | Riel | 114/356 |
| 3,870,615 | 3/1975 | Wilson et al. | 204/197 |
| 3,970,831 | 7/1976 | Hegyi | 156/363 |
| 4,082,588 | 4/1978 | Anderton et al. | 156/71 |
| 4,236,956 | 12/1980 | Harrison et al. | 156/579 |
| 4,415,293 | 11/1983 | Engel et al. | 204/197 |
| 4,468,310 | 8/1984 | Sabins | 204/197 |
| 4,496,444 | 1/1985 | Bagnulo | 204/197 |

OTHER PUBLICATIONS

Morgan, "The Economics . . . Protection" Corrosion Technology, (Nov. 1964), pp. 53–55.

*Primary Examiner*—Merrell C. Cashion, Jr.
*Attorney, Agent, or Firm*—Sherman and Shalloway

[57] ABSTRACT

The present invention relates to a new method of protecting the hulls of marine vessels from fouling. The inventive method involves the application of thin metallic films to the hull of a boat. The inventive method includes the use of various techniques for application of the film, techniques for preventing the touching of dissimilar metals, techniques for insuring that dissimilar metals are insulated and isolated from one another, insuring that active or passive cathodic protection systems are not on the same surface plane as the attached films and other techniques. The specific materials which are applied to the vessel hull as well as their various parameters in the environment of the present invention are disclosed.

8 Claims, 2 Drawing Sheets

Fig. 1
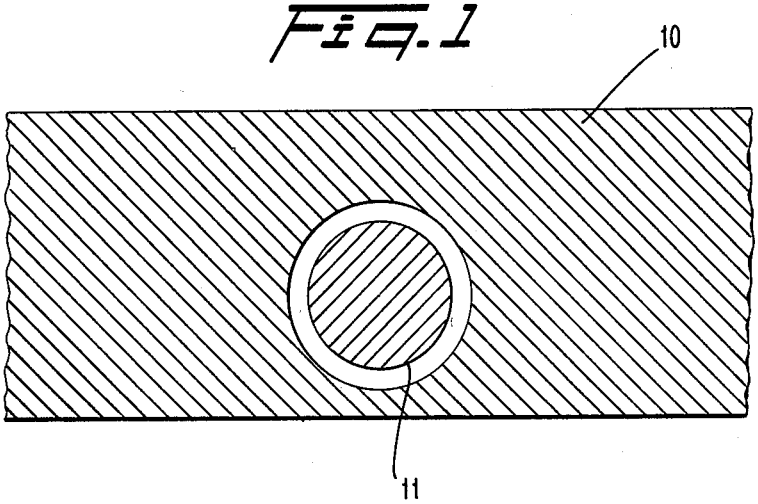
Fig. 2
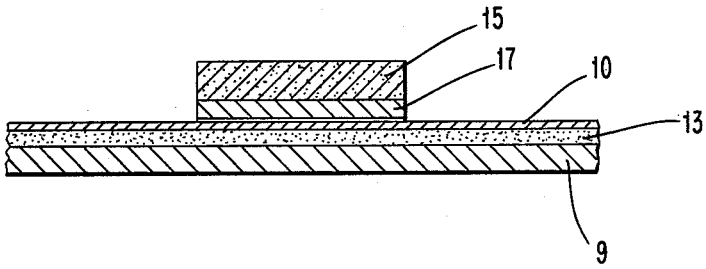
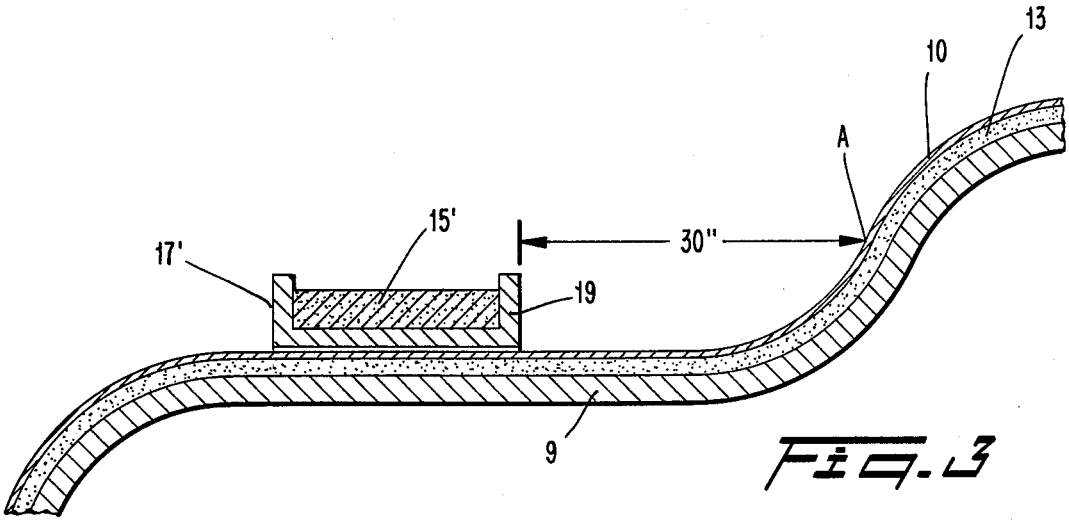
Fig. 3

METHOD OF PROTECTING THE HULLS OF MARINE VESSELS FROM FOULING

BACKGROUND OF THE INVENTION

Firstly, applicant wishes to incorporate by reference a disclosure document, number 142,050 which was filed Oct. 10, 1985 in the United States Patent and Trademark Office. A copy of this disclosure document has been included in the application papers filed with this application.

This patent application discloses an invention which is an improvement over an invention disclosed in U.S. Pat. No. 3,761,334 to Zondek and the corresponding reissue patent RE. 30,771, dated Oct. 13, 1981.

The Zondek patent and reissue patent disclose a method of protecting the hulls of marine vessels from fouling which includes the application of a thin copper foil to the hull in a plurality of strips. The inventive method is disclosed as being useable with steel, aluminum, wood and fiberglass hulls and the patent discloses the manner in which the hull should be properly prepared before the metallic foil is applied thereto. As disclosed, the foil is applied to the hull through the use of a layer of adhesive between the foil and hull which adheres the foil thereto. Also disclosed is the manner of overlapping of the respective foil strips and a roller device preferably formed of neoprene or other elastomeric material so that it may conform closely to the hull configuration of the vessel and so that it may press the foil into firm contact with the hull throughout the area where the foil is being applied. As disclosed, the roller is preferably coated with a silicone compound or other non-adhesive coating so that it has no tendancies to stick to the foil. The patent discloses the advantages of the adhesive attachment of the foil to the hull and cites examples of these advantages. For example, "In the case of a wood hull, the adhesive provides an additional coating protecting the hull. The adhesive is of a character that remains flexible and retains its adhesiveness for the life of the foil covering."

The following deficiencies are found in the invention disclosed in the above-discussed patent and reissue patent, which deficiencies have necessitated further research into the hull protection art to find better ways of applying a foil and performing other hull protecting techniques to the optimum manner:

(a) If the foil is applied to the boat hull in the exact manner specified in the patent and reissue patent, destructive electro-chemical corrosion will immediately commence when the vessel is placed in the water whether that water be fresh, salt or brackish in nature. This corrosion will eventually lead to the dezincification and eventual failure of bronze through-hull fittings, rudders, propellers, propeller struts and propeller shafts. This corrosion will also cause marine vessel hulls and components made from steel and aluminum to reject any adhesive bonding with copper-nickel anti-fouling metal. At present, this rejection is caused by electrical ions flowing in a path between the more noble copper-nickel, through the adhesive and to the vessel or hull substrate made of less noble materials.

(b) At present, there is no means for reducing the erosion rate of the copper-nickel anti-fouling sheathing. As such, excessive wear rates occur and the useful life of the foil disclosed in the patent and reissue patent is now no more than five (5) years at best.

(c) All technology, previously known, which reduces any electro-chemical corrosion also negates or significantly reduces the anti-fouling abilities of the copper-nickel metal within a 30-inch radius of any cathodic protection anode system contained in the same plane.

(d) Marine vessel transducers suffer signal strength decreases and image distortions due to unprotected electro-chemical reactions between their outer casings and the copper-nickel anti-fouling metal.

(e) Catalyzed adhesives are not used, disclosed or specified in the patent or reissue patent and such adhesives would be helpful in enhancing the effectiveness and lifetime of the applied films.

(f) The patent and reissue patent fail to disclose a complete procedure so as to appropriately apply a copper-nickel anti-fouling metallic foil through the use of pressure sensitive adhesive. As now known in the prior art, methods of applying heat sensitive adhesives using butt joints and overlap do not go far enough in providing the specific techniques which will enhance the installed lifetime of such adhesives.

(g) It is important to note that most pleasure boats are now constructed with hulls having strakes. The patent and reissue patent fail to disclose any method which could be used to properly apply the metallic foil over a marine vessel hull having such strakes.

(h) The patent and reissue patent do not discuss the length of time which it would take to install the metallic foil as disclosed therein per unit area. Applicant herein has experimented with the installation of a foil in accordance with techniques disclosed in the patent and reissue patent and has found that it takes 14 man-days to install 300 square feet of foil. This results in extremely high labor costs for the installation of the foil on a hull which render the foil and technique for its installation as disclosed in the patent and reissue patent extremely uneconomical.

(i) The patent and reissue patent fail to disclose any procedure or method to prevent the adhesive bond failures which would result from surface contamination including through the existence of oils which may form on new or used hull surfaces.

(j) Finally, the patent and reissue patent fail to disclose any method for repairing damaged foil sections while the vessel is in the water.

SUMMARY OF THE INVENTION

The present invention including apparatus and methods is specifically designed to overcome each and every one of the deficiencies as set forth above which are evident in the prior art.

In a first aspect, in accordance with the present invention, absolutely no contact is permitted between the copper-nickel anti-foulant metal and any and all dissimilar metals. Further, all underwater fittings are electrically connected together so that are maintained at the same electrical potential.

In a further aspect, a new active or passive cathodic protection anode system is provided which reduces corrosion of protecting materials which have been attached to the vessel. These materials enable the owner of the vessel to control dezincification so as to limit dezincification to only those materials designed to be sacrificial in nature and not in any of the vital underwater fittings of the vessel and/or hull.

In order to prevent the transfer of electrical voltages in damaging quantities between copper-nickel anti-fouling metals and aluminum vessel hulls, an insulating barrier may be provided interposed between the attached film and the hull. Such insulating barriers must have a dielectric characteristic of less than than 600 millivolts hull potential for aluminum hulls. In the case of fiberglass hulls or vessels, the potential between copper-nickel anti-fouling metal and typical bronze through-hull fittings and all underwater struts, props, rudders and shafts must be +0.22 volts.

In a further aspect, since high erosion rates are discovered to exist in underwater bow areas of marine vessels coated with a copper-nickel anti-foulant metal, additional quantities of sacrificial cathodic protection materials are required in that region. When such additional materials are in fact applied, the useful life of applied sheathing is dramatically increased.

In active or passive cathodic protection systems in accordance with the present invention, the protection system does not touch the anti-foulant metal, is not contained on the same surface plane as the anti-foulant metal and this is maintained through the use of insulating devices, and the system is shielded by insulating devices so that any curved underwater surface which has been sheathed by anti-foulant metal foil is always spaced at least 30 inches, in the same plane, from any cathodic protection system component.

The inventive metal sheathing may be attached to any marine vessel or hull by means of any form of catalyzed adhesive. If a pressure sensitive adhesive is used, all raw edges must face aft and these edges are overlapped by a predetermined amount and are sealed by means of a waterproofed sealant which is toxic to marine plants and creatures.

In a further aspect, if the vessel hull construction is such that strakes are present, a separate installation procedure is disclosed as will be set forth in greater detail hereinafter.

Furthermore, the inventive copper-nickel foil is installed in a new manner as disclosed in this patent application, which manner increases the speed of installation to thereby reduce the cost of the product as installed. When a technique of installation is used involving severe overlap, the surface of the foil which is to be covered by the overlapping foil must have its surface treated with special chemicals so as to facilitate the installation.

In a further aspect, the metallic foil as attached to the vessel may be repaired while the vessel is underwater through techniques disclosed hereinbelow.

Accordingly, it is a first object of the present invention to provide a new improved copper-nickel anti-foulant metal foil.

It is a further object of the present invention to provide such a foil which may be applied using the specific techniques disclosed hereinbelow so as to promote and facilitate a long useful life on the vessel beyond that which is known in the prior art.

It is a still further object of the present invention to provide such a metallic foil along with other structures and techniques which not only enhance the life of the foil on the vessel but also reduce the incidence of corrosion or other hull damage.

These and other objects, aspects and features of the present invention will be better understood from the following detailed description of the preferred embodiments when read in conjunction with the appended drawing figures.

BRIEF DESCRIPTION OF THE DRAWINGS

FIG. 1 shows a side view of a portion of a vessel hull incorporating the present invention thereon.

FIG. 2 shows a cross-sectional view through a portion of the hull of a vessel illustrating another aspect of the present invention.

FIG. 3 shows a further cross-sectional view through another portion of the hull of a vessel and showing another aspect of the present invention.

SPECIFIC DESCRIPTION OF THE PREFERRED EMBODIMENTS

Figure 4:
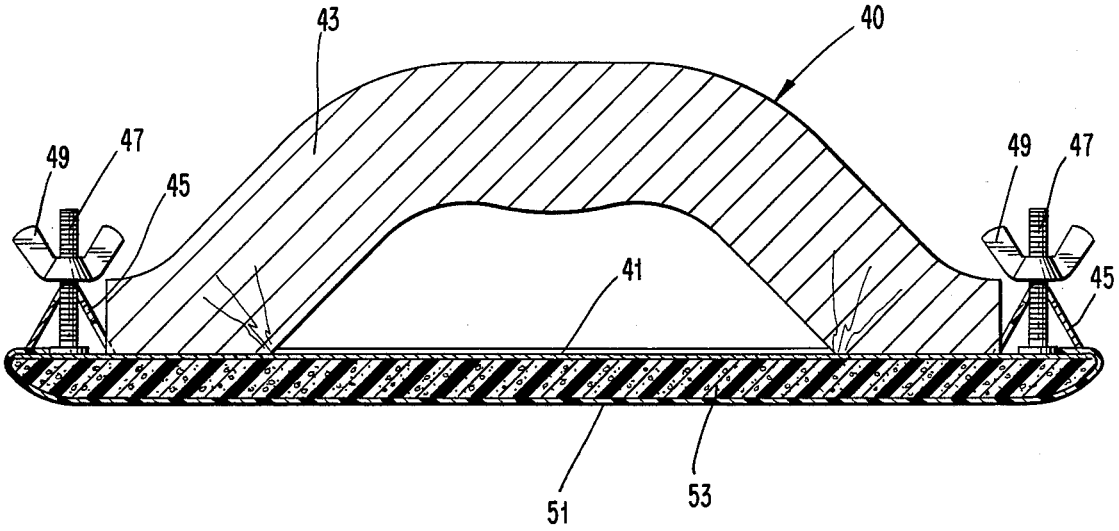
FIG. 4 shows a cross-sectional view through a tool which has been devised by applicant to apply the foil to a vessel hull.

The present invention combines specific structures with specific techniques so as to overcome each and every one of the deficiencies in the prior art as set forth hereinabove in the background of the invention.

In one aspect of the present invention, it is contemplated to apply a copper-nickel anti-foulant metallic foil to the hull of a vessel using techniques to be described in greater detail hereinafter and through the use, in most cases, of an adhesive layer between the foil and the hull. If desired, the adhesive layer may be attached to the underside of the foil and may be protected, initially, by a release layer, or, if desired, the adhesive may be painted onto the hull and thereafter, the foil may be applied thereto.

The adhesive must be compatible with properly prepared copper/nickel surfaces so that it will adhere to the surfaces and will remain attached and waterproof while the surfaces are underwater, in motion at speeds up to 100 knots, while simultaneously functioning as a waterproof edge sealant and an anti-foulant. Applicant has developed a waterproof edge sealant suitable for use in the inventive method that is an anti-foulant, and an adhesive of this or similar nature must be used on all copper/nickel foil edges on marine vessels, stationary or mobile.

This preferred edge sealant is comprised of either powdered, milled, chipped or ground copper, copper/-nickel or cuprous oxide in approximately 100 micron size particles or larger, mixed into the adhesive so that no less than 60% of the resultant edge sealant by volume is comprised of the encapsulated particles of anti-foulant materials. The adhesive itself preferably is of a catalyzed nature such as vinylesters, epoxies, silicone, polysulfides or any other adhesive that is waterproof and will remain in bond to copper/nickel surfaces underwater and in motion.

Application of this material should be done with a syringe type plunger or pressure applicator modified so that only the aft edges of the anti-foulant copper/nickel foil are covered and sealed. The opening in the applicator and resulting sealant-anti-foulant edge bead should be no larger than about $\frac{1}{8}$" in diameter to preclude unnecessary drag while the vessel is in motion.

In the preferred embodiment of the present invention, a foil material having the following constituent components has been found to be highly effective in the environment of use of the present invention:

| CHEMICAL ANALYSIS OF PREFERRED FOIL | |
|---|---|
| Element | Percent |
| Mn | .63 |
| Fe | .83 |
| Ni | 15.4 |
| Cr | .679 |
| Zn | .05 |
| Pb | .008 |
| Cu | Balance |

In the foils of the above chemical analysis which have been used by applicant, the above quoted percentage for nickel includes a small amount of cobalt. Further, in the preferred embodiment, the foil is annealed through the use of well known techniques and has a thickness of 0.005 inches or greater. Tests by applicant on such a foil in strips approximately two inches wide have revealed an average grain diameter of 0.0001333 inches, a yield strength of 20,000 psi ±2 percent, a tensile strength of 46,000 psi ±2 percent and a percent elongation without yielding of 31 percent.

In order to optimize the effects which are attained through the teachings of the present invention, several rules must be adhered to. Firstly, absolutely no contact is permitted between the copper-nickel anti-foulant metallic foil and any and all dissimilar metals on such structures as, for example, through-hull fittings, propeller struts, propeller shafts, rudders, pintles, gudgeons, bolts, nuts or washers. In the preferred embodiments of the present invention, it is desirable to maintain at least one-half inch clearance between the metallic foil and any and all dissimilar metals. Alternatively, these fittings may be made of a material which does not negatively interact with the foil.

This is illustrated in FIG. 1 wherein the foil 10 is seen to be spaced circumferentially about a hull fitting 11 in such a manner that the dissimilar metals respectively comprising the foil and the fitting do not under any circumstances engage one another.

In a further aspect, in order to enhance the present invention, all underwater fittings such as through-hull fittings, propeller struts, propeller shafts, rudders, pintles, gudgeons, bolts, nuts, washers and screws must be connected together with a common copper wire of at least 22 gauge or larger so that all of these underwater fittings are maintained at the same electrical potential.

In a further aspect of the present invention, a new active or passive cathodic protection anode system is provided with the following specifications:

(a) The system will provide and maintain a protection ratio of five (5) milligrams or less of corrosion of the metallic foil per 100 square meters of wetted marine vessel surface area.

(b) The anode materials in the passive cathodic protection system may be made of any one of magnesium, aluminum, zinc, chromium, iron, cadmium or nickel. The materials must be attached to the hull so that they do not touch the metallic foil. Further, these components must be isolated from the metallic foil in such a manner that they do not lie on the same plane thereof. This may be accomplished through the use of an insulating mounting disc, block, plate, holder or other inert device. In this regard, FIG. 2 shows the hull 9 with the foil 10 adhered thereto through the use of an adhesive layer 13. The cathodic protection system 15, as shown in FIG. 2, comprises inzinc which is separated from the foil 10 by virtue of an insulative layer 17. Further, as best seen in FIG. 3, the cathodic protection system must be shielded in such a manner that any curved underwater surface which is coated or sheathed with the metallic foil is at least 30 inches away from the cathodic protection system component in the same plane thereof. With reference to FIG. 3, the hull 9 is seen to have a metallic foil 10 thereon attached by virtue of an adhesive layer 13. Inzinc 15' is mounted thereon by virtue of an insulative container 17' having walls 19 which isolate the inzinc 15' from the surface A of the foil 10 which as seen in FIG. 3 might lie in the same plane as portions of the inzinc 15'.

The purpose of the inzinc is to provide cathodic protection, to maintain the anti-fouling nature of the copper-nickel metallic foil, to reduce erosion of the foil and to reduce bonding failures through ion exchanges which normally occur in the inventive environment.

(c) Further, concerning the cathodic protection system, if an active cathodic protection system or impressed current system is used, the above-described corrosion rate of five (5) milligrams per 100 square meters may be preserved by adjusting the number and placement of the reference anodes or negative cathodes. If the five (5) milligram per 100 square meter corrosion rate is maintained, the dezincification problems of the prior art patents are eliminated since dezincification will only be permitted in those materials designed to be sacrificial in nature and will not occur in any of the underwater fittings of the marine vessel hull.

In a further aspect, the metallic foil must include a dielectric barrier film or, alternatively, the attached bonding adhesive itself must have this dielectric (insulative) characteristic so that the film and/or its associated adhesive has not more than 600 millivolts hull potential. Chlorinated rubber applied to steel and aluminum substrates of all marine vessels has been found to meet the requirements of a dielectric barrier for the application of copper/nickel foil or spray applications. Any other rubber such as reclaimed rubber will have contamination from carbon and will negate the dielectric characteristics required, and is thus undesirable. In order to enhance the operation of the present invention, marine vessel hulls, pipes, tubes, conduits, rods and appendages which are made from steel or steel alloys and having the copper-nickel metallic foil adhered thereto must have either a dielectric (insulating) barrier film or the attached adhesive must have the dielectric characteristic through inherent properties or through adjustable thickness so as to have no more than 200 millivolts of hull potential.

The above discussed discoveries have been found by applicant to prevent the transfer of electrical voltages in damaging quantities from the metallic foil. Experiments by applicant have led to the conclusion that transfer of electrical voltages from the copper-nickel anti-fouling metallic foil is approximately at a level of +0.34 volts, to an aluminum marine vessel hull substrate, the electrical voltage transfer is approximately −1.67 volts and to a steel or steel alloy marine vessel substrate, the transfer of electrical voltages is at a level approximately −0.44 volts. The present invention, by preventing the transfer of any surface to substrate voltages, eliminates corrosions which would normally lead to adhesive bond failures and loss of the inventive foil. further experimentation has revealed that for fiberglass hulls or vessels, the potential between the copper-nickel metallic foil and the typical bronze through-hull fittings and all underwater struts, props, rudders and shafts must be approximately +0.22 volts.

Since high erosion rates are discovered to always exist in the underwater bow areas of marine vessels which are coated with a copper-nickel metallic foil, sacrificial cathodic protection materials in a passive system or sufficient active suppression system components must be placed in the bow area so that the corrosion is limited to the five (5) milligrams per 100 square meter ratio which was explained hereinabove. When such adequate cathodic protection components are located in the underwater bow areas, the rate of copper-nickel metallic foil loss will be seriously reduced and the useful life of the copper-nickel metallic foil may be increased to as long as approximately 20 years. Of course, pure copper foils may not be applied in high erosion area such as, for example, rudders and bow/-forepeak areas.

As explained above, with reference to FIGS. 2 and 3, certain parameters must be followed in applying cathodic protection systems. In a further aspect, in this regard, the sides of the shielding for the protection system should be adjusted to allow for hull curvature so as to prevent ions from transferring in the same plane of the hull to the plane of the cathodic protection system to within 30 inches of the cathodic component. This is illustrated in particular in FIG. 3.

In a further aspect of the present invention, the copper-nickel anti-foulant metal sheathing may be attached to any marine vessel or hull by means of any form of catalyzed adhesive. In the preferred embodiments of the present invention, the catalyst may be applied to either the hull or the foil after cleaning procedures to be discussed in greater detail hereinafter are employed.

In a first aspect of the application of the foil sheathing, if a pressure sensitive adhesive is to be used to attach the copper-nickel anti-foulant metallic foil, all raw edges must face aft and these edges must be overlapped by a predetermined amount, for example, one-half inch. These raw edges must thereafter be sealed through the use of a waterproof sealant which is toxic to marine crustaceans, toredos and organic growth. An example of a sealant which is suitable for use in this application is Dolfinite 3905TX or its equivalent and such a sealant is required to be applied to all exposed raw edges of the foil regardless of the type of adhesive used.

If the construction of the hull is such that strakes are present, a particular special installation is specified. In this regard, a narrow rectangular section of the foil is cut to first cover the straight sections of the underwater hull strake. This rectangular section must be the first section to be attached to the hull before any other sections of the foil are applied.

Through experimentation, applicant has discovered that a particular manner of installation of the foil, when carefully followed, will significantly reduce the labor costs and time which is necessary to install the foil. In this procedure, firstly, the installers must start at the port side of the transom at the water line and pieces of foil of up to 24 inches in width are applied to non-curved surfaces in a maximum length until a curved section of the hull, obstruction or bend is encountered. This procedure is commenced at the water line or, alternatively, at the highest line of foil application and is continued in horizontal bands around the marine vessel or hull down to the keel. Applicant has found that a two-man team can install two (2) to three (3) square feet of foil per minute using this technique. Of course, overlapping of the respective foil pieces as discussed hereinabove must be done.

To further increase the speed of foil installation and to thereby reduce the cost of the product, including installation costs, a computer may be used in conjunction with a sensor such as a "mouse" which may be moved over the hull surfaces so that the computer, through the use of software, may generate in its memory the hull shape. The computer, as programmed, may calculate the exact shape of the pieces of foil which must be cut so as to accurately and completely cover the hull, taking into account the overlap techniques discussed hereinabove. Then, means associated with the computer may be used to cut the foil using techniques well known to those skilled in the art, into the appropriate sections which may then be numbered for installation sequencing either manually or by the computer and associated hardware. Through the use of these techniques, the total costs on a per square foot basis for installing the inventive foil are only approximately one-half the costs for the installation of foils in the manner taught in the prior art.

In further elaboration of the above described foil installation techniques, when a "mouse" is moved over the hull surfaces, the computer generates the hull shape at that point thereon. Thus, in order to provide to the computer a clear indication of the shape of the hull over its entirety, the "mouse" is moved over the hull surfaces in a direction substantially perpendicular to the direction of elongation of the keel of the vessel. Such movements of the "mouse" are done at spaced intervals substantially perpendicular to the direction of elongation of the keel with the spacing between measurements being determined, mainly, by the width of the strips of material which are to be applied to the hull, taking into account the desired overlap of the respective strips. After the "mouse" has been used so that the computer has in its memory the entire configuration of the hull, this information may be programmed into a computer controlled device which may be used to properly cut the strips of foil which are to be installed over the hull. Cybermation, Incorporated of Cambridge, Mass. has developed cutting devices using plasma cutting techniques which have integrated therewith computer software into which may be preprogrammed the specific desired cuts. The devices manufactured by Cybermation, Incorporated may be utilized to cut the foil which is to be applied to the boat hull in accordance with the teachings of the present invention with data from the computer as to the hull configuration being inputted into the computer of the Cybermation, Incorporated machine so that the specific strips of foil may easily be cut. The computer cutting procedure is additionally particularly useful in laying up the copper/nickel foil in the molds of fiberglass marine vessels. The computer designed pre-cut sections are laid up in the mold and initially attached to the mold by a water soluble release agent. The hull layup is then accomplished in a normal manner except that the copper/nickel foil is now permanently bonded to, and an integral part of the wetted surface area with no additional adhesive application required.

When the above described overlap edge technique is used, the surface of the previously applied metallic foil which is to be overlapped must have its surface wiped free of all oils and contaminants with a highly evaporative solvent or reducer, such as, for example, mineral spirits, tolulene, acetone, naptha benzene or any other solvent or reducer which dissolves the surface contamination, removes any oils thereon and leaves no residue. The same cleaning techniques must be utilized before laminating or applying any adhesive to any roll or panel of foil.

With reference now to FIG. 4, a tool has been devised by applicant which is quite useful in applying the foil to the hull of a vessel. With reference to FIG. 4, it is seen that the tool 40 includes a base plate 41, a handle 43 fastened thereto and mounting brackets 45 releasably engaging the plate 41 through the use of bolts 47 having removable wing nuts 49 threadably received thereon.

The brackets 45 have clamped therebeneath the ends of a smooth strip 51 of material, preferrably nylon, under which is placed a strip 53 of flexible foam material. The foam material 53 is provided so that when the nylon strip 51 is engaged with the foil material, any irregularities caused by either the foil or the hull are not damaged by the device 40 due to the inherent give of the foam material 53. After the foil has been smoothed through the use of the device 40, a roller such as that which is used in wallpapering operations may be utilized to finalize the installation including the removal of bubbles and the pressing of the adhesive tightly between the hull and foil.

Figure 5:
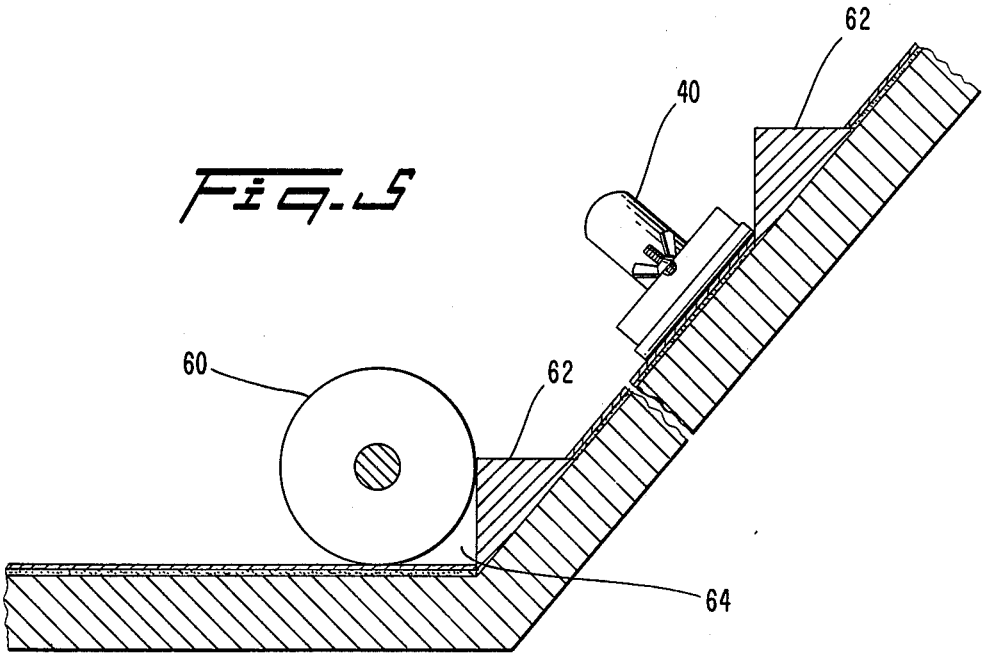
FIG. 5 shows a cross-sectional view through a portion of a vessel hull illustrating tools used in applying foil thereto.

Applicant has developed his own application tools to remove sub-surface air pockets under the adhesive which bonds the copper/nickel foil. Since 95% or greater contact areas are required to keep the anti-foulant and adhesive materials attached to the marine vessel in motion, applicant has found that for larger, flat-hull surfaces, a large, flat, non-stick application tool is required such as the tool 40. As the temperature of the ambient air and adhesive drops during application, to 75 degrees Fahrenheit or less, greater force has been found to be required to ensure a 95% adhesive bond; consequently, higher surface pressures are required by the applicator. These higher pressures can best be applied with two hands on the handle 43 which has been specifically designed for two hand use. To apply pressure in square corners, a square edge as shown is necessary; for radiused corners a corresponding radiused edge is necessary. The application tool surface must be smooth, non-stick in nature and renewable in the event of damage. The above described strip 51 fulfills these objectives. As shown in FIG. 5, since the roller 60 does not meet the above requirements, it has been found to be of very limited value. In the way of hull strakes 62, the roller 60 will not touch corner areas 64 and thus, the square edged tool 40 is essential.

In a further aspect of the present invention, on occasion, damages occur to the foil as it has been installed through collisions, accidental tearing and the like. Applicant has developed a procedure which may be utilized to repair the foil expeditiously. In this regard, all raw edges and damaged foil are removed, surface contaminations are removed from a dry section of repair foil using the cleaning techniques discussed above, an underwater epoxy layer of approximately one-eighth inch thickness is applied to this new foil section and the section is then installed in place on the hull and maintained in stationary position for approximately 24 hours. All edges, and particularly those edges which face forward on the vessel must have a beveled edge section to prevent and deter flowing water from impacting upon the repair section and consequently removing it from the hull inadvertently.

Applicant has found that application of the foil to the boat hull in the manner described hereinabove results in the following advantages:

(1) Avoids repainting and scraping costs which are increasing each year;

(2) Higher boat speed and lower fuel consumption and thus longer range from same throttle setting;

(3) Sail boats point higher;

(4) The hull is sealed - exposure to osmosis is reduced;

(5) Sound wood hulls are sealed against toredos;

(6) No corrosion occurs between foil and hull;

(7) Environmentally safe - no noxious fumes as from paint; thus no water pollution;

(8) The foil is self polishing/cleaning with the vessel moving at about 7 knots for 30 minutes per week;

(9) Since the inventive foil as applied in accordance with the teachings of the present invention may last up to 15 years, savings over annual bottom painting expenses are significant.

Accordingly, an invention has been disclosed herein which overcomes each and every one of the deficiencies in the prior art as discussed hereinabove and which provides a new and improved method of installing a metallic foil on a vessel hull which is greatly reduced in cost and greatly increased in life. Various changes, modifications and alterations may be contemplated by those skilled in the art to the teachings of the present invention, and such modifications, changes and alterations are intended to be construed as being included in the teachings of the present invention. Accordingly, it is intended that the present invention only be limited by the terms of the appended claims.

I claim:

1. A method of protecting a hull of a marine vessel from fouling, including the steps of:

(a) measuring the surface configuration and shape of the hull;

(b) cutting a plurality of strips of predominantly copper foil material which together, taking into account intended strip overlap, correspond to said surface configuration, said hull including at least one structure thereon made of a metal of dissimilar composition from the composition of said foil material, (c) applying said strips of foil material to said hull in overlapping relation while maintaining isolation of said foil material from said at least one structure by physically spacing said foil material from said at least one structure so that currents are not conducted therebetween;

(d) smoothing said strips of foil material on said hull with a smoothing device; and (e) rolling a roller device over said strips of foil to adhere said strips of foil to said hull and to eliminate bubbles therefrom.

2. The method of claim 1, wherein said measuring step is accomplished by running a computer mouse over said hull at spaced intervals at an angle to the keel of said vessel and recording, in said computer, data indicative of said surface configuration and shape.

3. The method of claim 2, wherein said cutting step is carried out by inputting data into a computer controlled cutting machine from said first mentioned computer and said cutting machine cutting said strips.

4. The method of claim 1, wherein said foil material includes about 15% nickel.

5. The method of claim 4, further wherein after said applying step, all underwater fittings of said vessel are electrically interconnected so that they are maintained at a common potential.

6. The method of claim 4, further wherein after said applying step, a cathodic protection system is installed on said hull.

7. The method of claim 4, wherein said applying step includes the step of interposing a dielectric barrier between said foil material and said hull.

8. The method of claim 7, wherein said dielectric barrier comprises adhesive with dielectric properties which adhere said foil material to said hull.

* * * * *